US007688990B2

(12) United States Patent
Hellgren et al.

(10) Patent No.: US 7,688,990 B2
(45) Date of Patent: Mar. 30, 2010

(54) HEARING AID WITH ANTI FEEDBACK SYSTEM

(75) Inventors: Johan Hellgren, Hellerup (DK); Thomas Bo Nielsen, Hellerup (DK)

(73) Assignee: Oticon A/S, Smorum (DK)

( * ) Notice: Subject to any disclaimer, the term of this patent is extended or adjusted under 35 U.S.C. 154(b) by 458 days.

(21) Appl. No.: 10/593,586

(22) PCT Filed: Mar. 15, 2005

(86) PCT No.: PCT/EP2005/051167

§ 371 (c)(1),
(2), (4) Date: Sep. 21, 2006

(87) PCT Pub. No.: WO2005/091675

PCT Pub. Date: Sep. 29, 2005

(65) Prior Publication Data

US 2007/0206824 A1 Sep. 6, 2007

(30) Foreign Application Priority Data

Mar. 23, 2004 (DK) ..... 2004 00472

(51) Int. Cl.
*H04R 25/00* (2006.01)

(52) U.S. Cl. ..... 381/312; 381/92; 381/313; 381/318

(58) Field of Classification Search ..... 381/91, 381/92, 93, 122, 312, 313, 317, 318, 320, 381/321, 356, 357, 358, 71.11
See application file for complete search history.

(56) References Cited

U.S. PATENT DOCUMENTS

| | | | | |
|---|---|---|---|---|
| 5,259,033 | A * | 11/1993 | Goodings et al. | 381/318 |
| 6,072,884 | A | 6/2000 | Kates | |
| 6,434,246 | B1 | 8/2002 | Kates et al. | |
| 6,498,858 | B2 * | 12/2002 | Kates | 381/318 |
| 7,010,134 | B2 * | 3/2006 | Jensen | 381/313 |
| 2001/0002930 | A1 | 6/2001 | Kates | |
| 2003/0112987 | A1 | 6/2003 | Nordqvist et al. | |

FOREIGN PATENT DOCUMENTS

| | | | |
|---|---|---|---|
| EP | 1 191 814 | A1 | 3/2002 |
| WO | WO-01/06746 | A2 | 1/2001 |

* cited by examiner

*Primary Examiner*—Huyen D Le
(74) *Attorney, Agent, or Firm*—Birch, Stewart, Kolasch & Birch, LLP

(57) ABSTRACT

A hearing aid with anti feed back system, the hearing aid including a signal path from at least one input transducer to an output transducer, a signal processing unit, acoustic environment detection capability, and a parameter generator that generates input to the setting of signal processing parameters to be used in the signal processing unit based on either manual input or from the results of acoustic environment detection, and an alert signal generator that generates an alert signal to the anti feed back system whenever one or more preselected input to the generation of signal processing parameters undergoes changes.

18 Claims, 3 Drawing Sheets

HEARING AID WITH ANTI FEEDBACK SYSTEM

AREA OF THE INVENTION

The invention relates to hearing aids and other audio equipment wherein feed back may occur when a captured audio signal is repeated by a loudspeaker (in hearing aids named the receiver) is recaptured by the microphone and further amplified.

BACKGROUND OF THE INVENTION

In hearing aids and other audio equipment it is often necessary to use anti feed back system in order to avoid the feed back problem. The anti feedback system may however be disturbed when changes occur in the signal path such as changes in directionality or changes in the choice of program effected either manually or automatically. The invention tries to avoid the problems which relates to correlation between anti feed back systems and fast changes in the signal processing in the signal path.

SUMMARY OF THE INVENTION

The invention solves the problem that the hearing aid may start to howl when the directional processing changes mode or when other changes in the signal processing mode are provoked manually or by shifts in the environment.

According to the invention a hearing aid with anti feed back system is provided where the hearing aid further comprises:

- a signal path from at least one input transducer to an output transducer,
- a signal processing unit,
- acoustic environment detection means,
- means for generating input to the setting of signal processing parameters to be used in the signal processing unit based on either manual input or output from the acoustic environment detection means,
- means for generating an alert signal to the anti feed back system whenever one or more preselected input to the generation of signal processing parameters undergoes changes.

The alert signal is used by the anti feed back system to change its mode, possibly such that a faster adaptation will take place.

In an embodiment of the invention one of the preselected input to the generation of signal processing parameters relates to processing of a directional characteristic of signals received from two or more microphones. The directionality may change between an omnidirectional and a directional signal, which is input to the signal processing unit, and when this happens the anti feed back block may not be able to adapt its filters fast enough. Here an indication from the directional calculation unit is used at the anti feed back block to ensure quick adaptation to the new situation.

In an other embodiment of invention wherein at least two different programs are comprised in the hearing aid, and means for automatic shifting between the programs based on the environment detection are also provided, one of the preselected input to the generation of signal processing parameters relates to the automatic or manual selection of a programme. Program shifts may also effect the anti feed back unit, and according to this embodiment of the invention it is assured information on program shifts, be it automatic shifts or manual shifts, are relayed to the anti feed back unit, such that adaptation rate may be adjusted to quickly track the resulting changes in the signal path.

DESCRIPTION OF A PREFERRED EMBODIMENT

Figure 1:
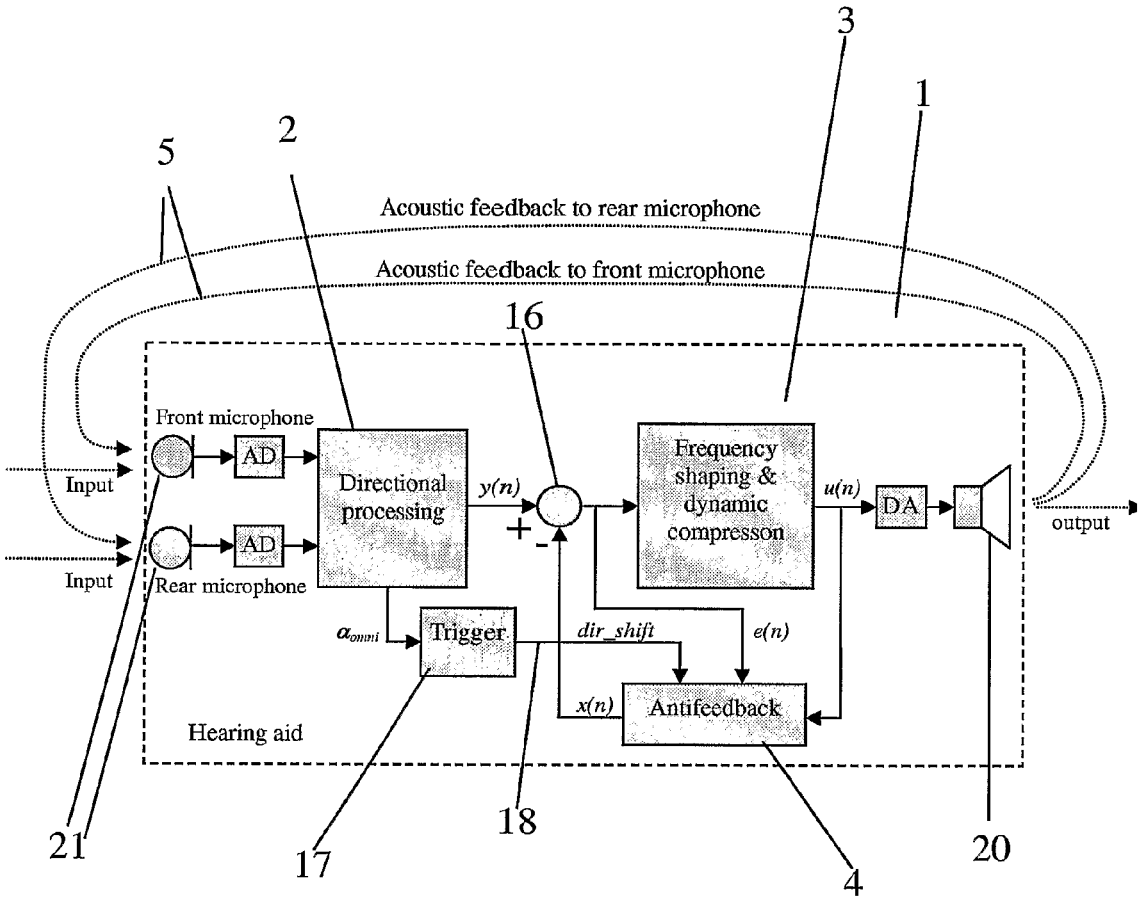
FIG. 1 show a schematic representation of the hearing aid.
Figure 2:
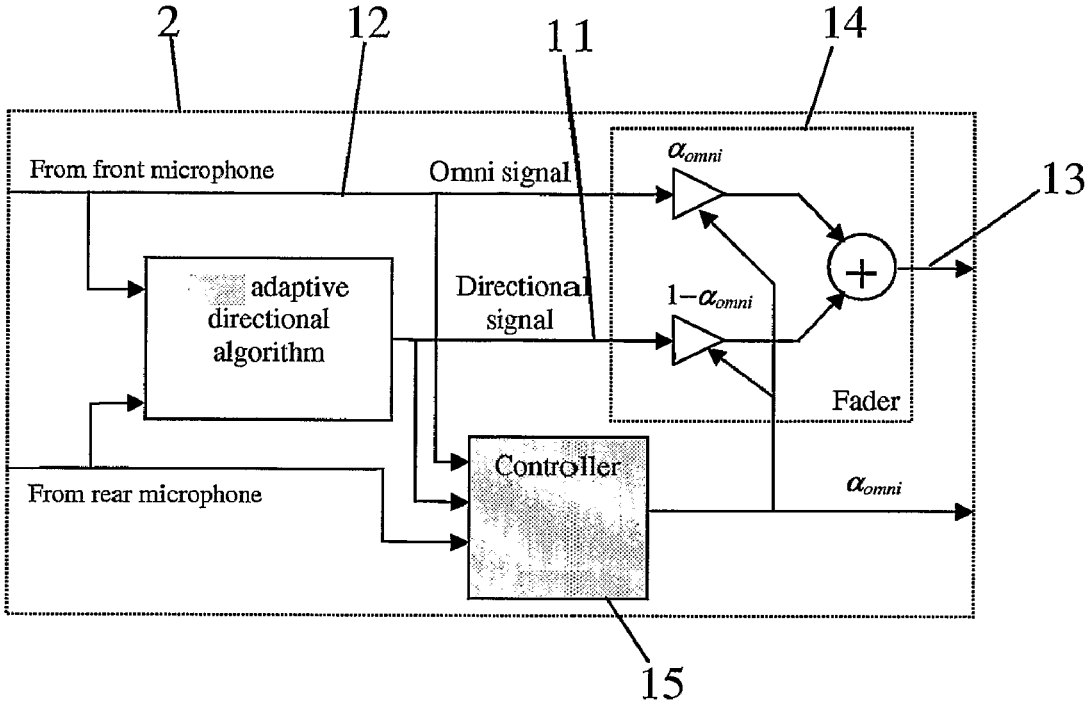
FIG. 2 shows a diagram of the directional block.
Figure 3:
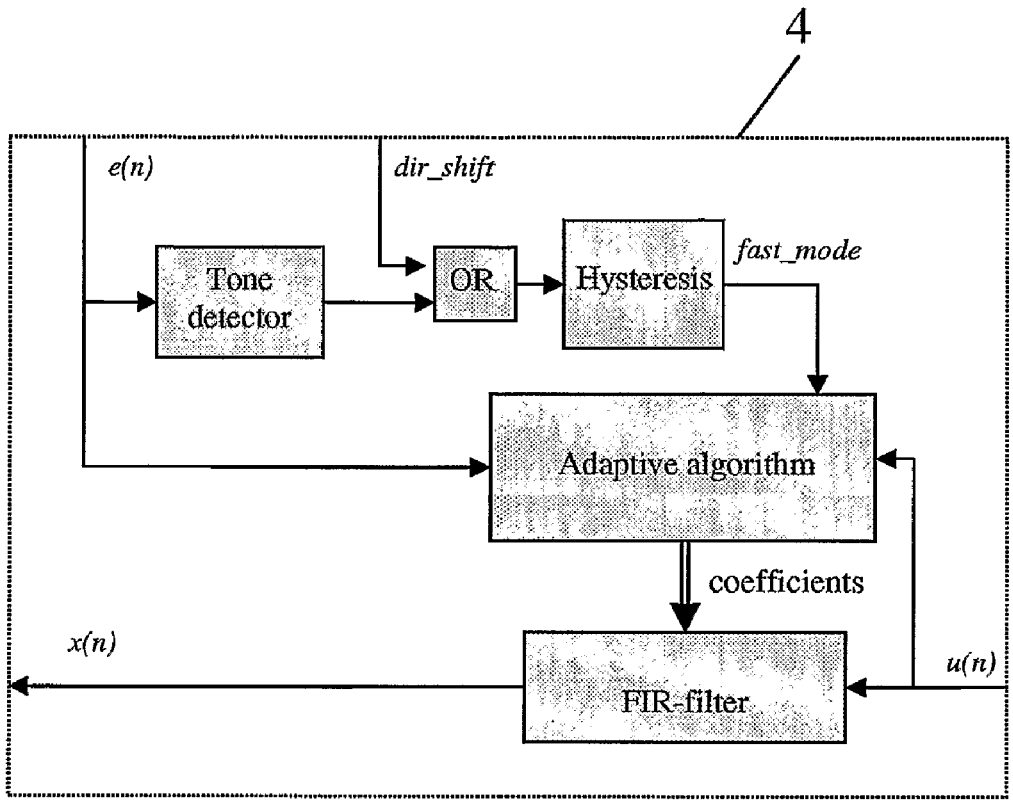
FIG. 3 is a diagram showing the function of the anti feedback block.

The hearing aid 1 according to the presented embodiment comprises a block for directional processing 2, a block for frequency shaping 3 and a block for anti feedback processing 4 configured according to FIG. 1. The directional processing 2 can automatically switch between a directional mode, where signals with other incidents than frontal are attenuated, and an omni mode. The anti feedback system cancel the part of the input signal that is feedback and is used to allow for more gain without howl. As seen in FIG. 2, the directionality block 2 generates two signals; a signal with directional sensitivity 11 and an omni signal 12. The output 13 of the block 2 will either be the one of these signals or a combination of the two. This is implemented with a fader 14 at the output of the block 2. The fader 14 applies gain to the two signals 11,12 before adding them. The gain applied to the omni-signal is called $\alpha_{omni}$ and have values in the range [0 1]. The gain applied to the signal with directional sensitivity 11 is $(1-\alpha_{omni})$. $\alpha_{omni}$ is controlled by a controller 15 programmed to use the levels of the signals and estimation of signal to noise ratio in the input signal as well as possible other parameters to automatically choose the desired mode for the hearing aid user. The controller 15 can thus automatically change between the omni signal 12 and the directional signal 11. When changing mode, $\alpha_{omni}$ will gradually fade from 0 to 1, or vice versa.

The directional signal is preferably generated using an adaptive algorithm, but also stationary directional algorithms could be used.

The frequency shaping block 3 contains a filterbank and compressors for frequency shaping and dynamic compression, which is used to modify the signal to fit to the impaired hearing of the user. This block could also contain other types of signal processing to enhance the signal, e.g. noise reduction.

The anti feedback (AFB) block 4 generates an internal feedback path. The purpose of this path is that it should have the same characteristics as the external feedback path via the receiver 20, acoustic paths 5, microphones 21, and directional block 2. If equal, the feedback caused by the external feedback paths 5 will be removed when x(n), the signal of the internal feedback, path is subtracted in the adder 16 after the directional block 2 in FIG. 1.

The AFB uses an adaptive algorithm to track the changes of the external feedback path. A parameterized model of the feedback is used where the parameters are the coefficients of the FIR-filter. The adaptive algorithm is based on a prediction error method, that adjusts the coefficients so that the energy in the residual signal after cancellation, e(n), is minimized.

The coefficients are updated with a step given by and adaptive algorithm with a predefined step size $\mu_0$. Possibly a normalized least mean square (NLMS) algorithm as describe in the following is used. This gives a step in the direction of steepest decent for the energy of e(n). The update is given by $$\theta(n) = \theta(n-1) + 2\frac{\mu_0}{\beta + \psi(n)'\psi(n)}\psi(n)e(n)$$

where $\theta(n)$ is a vector with the coefficients, $\psi(n)$ is a vector of same length as $\theta(n)$ with the last samples of $u(n)$, and $\mu_0$ is a scalar that defines the step size. $\mu_0$ will control how fast the adaptive filter can adapt to changes in the external feedback path.

One shortcoming of the adaptive filter is that it may adapt to tonal components of the input signal. The tonal component may then be attenuated. To reduce the sensitivity to tonal components a small $\mu_0$ (i.e. slow adaptation) can be used. However, the adaptation speed acquired with this $\mu_0$ will usually be to slow if the hearing aid becomes unstable and starts to howl.

Two alternative values of $\mu_0$ are used, one low value for slow adaptation to get good resistance to tonal components and a higher value to get fast adaptation when required. However, the $\mu_0$ is programmable, and a range of different values could be used if it is desired. The fast adaptation is used when the tone detector has detected howl. A hysteresis is used to allow for fast adaptation in a predefined period after the howl has vanished.

The external feedback paths 5 that the AFB tries to track is dependent on the DIR-block 2. The feedback path can change substantially when switching between omni mode and directional mode. The AFB will then be misadjusted if the adaptation speed is too slow compared to the transition time of $\alpha_{omni}$. As a result the hearing aid may start to howl at the automatic transitions between the omni signal and directional signal.

According to the invention the AFB system is forced to use fast mode when the directionality changes from omni mode to directional mode and thus prevents the hearing aid from howling due to too slow adaptation. The gain $\alpha_{omni}$ is used to monitor when changes occur. Values in the middle of the range from 0 to 1 will cause adaptation with the fast mode. The trigger 17 of FIG. 1 gives an output (dir_shift) 18 of 1 when the input, $\alpha_{omni}$, is in the specified range. Other values of $\alpha_{omni}$ will give an output of 0. The signal dir_shift 18 is in the AFB-block combined with the output of the tone detector in an OR-gate, so either of them can cause fast mode. The hysteresis insures that fast mode is used during the last part of the transition when $\alpha_{omni}$ has left the specified range.

Other changes of the processing such as manual or automatic program shifts may also be used to control the adaptation speed of the antifeedback algorithm. Here it should be mentioned that any change involving changes in the gain setting could be used to set the adaptation speed of the anti feedback algorithm. This could be changes in soft squelch, compression or noise damping. Also in systems with adaptive directionality as described above the change in directionality, which might take place in one or more bands could also be used as input to the changes of the adaptation speed of the anti-feedback algorithm.

The invention claimed is:

1. Hearing aid with an anti feedback system that operates in one of at least two adaptation modes, a fast adaptation mode and a slow adaptation mode, the hearing aid comprising:

a directional processing block that:

receives input signals from two or more microphones, generates a DIR-signal with directional sensitivity and an OMNI-directional signal, and provides, as an output signal, an addition of the DIR and OMNI signals, where the addition is performed by a fader that subjects both signals to gain factors before addition, and wherein the gain, $\alpha_{omni}$ applied to the OMINI-signal has a value between 0 and 1, inclusive, and wherein the gain applied to the DIR-signal is $(1-\alpha-_{omni})$, an acoustic environment detector that determines whether input signals from said microphones are directional or omni-directional, a trigger that generates an alert signal to the anti feed back system, said alert indicating the adaptation mode for the anti feedback system based on the value of $\alpha_{omni}$, and a controller that controls the trigger and the fader by generating a value for $\alpha_{omni}$ based on input from the acoustic environment detector.

2. Hearing aid of claim 1, wherein the anti-feedback system changes to a fast adaptation mode based on the alert signal.

3. Hearing aid of claim 1, wherein $\alpha_{omni}$ gradually changes its value from 0 to 1, or vice versa, when the directional processing block is changing mode.

4. Hearing aid of claim 1, wherein the trigger generates an alert signal indicating a fast adaptation mode when $\alpha_{omni}$ has a value in the middle of its value range.

5. Hearing aid as claimed in claim 1 wherein the anti feedback system includes an adaptive feedback tracking portion to track the changes of an external feedback path.

6. Hearing aid as claimed in claim 5 wherein the anti feedback system includes an FIR filter and a parameterized model of the feedback, where the model parameters are the coefficients of the FIR filter.

7. Hearing aid as claimed in claim 6 wherein the adaptive feedback tracking portion includes a prediction error method that adjusts model parameters so that energy in a residual signal after cancellation is minimized, and wherein the parameters are updated with a step given by an adaptive algorithm with a predefined step size $\mu_0$, wherein $\mu_0$ determines the adaptation speed of the FIR filter.

8. Hearing aid as claimed in claim 7 wherein the step size is adjustable.

9. Hearing aid as claimed in claim 7 wherein there is a large and a small value of $\mu_0$ such that the small value causes slow adaptation of the FIR filter, and the large value causes fast adaptation of the FIR filter.

10. Hearing aid as claimed in claim 9 wherein the anti feedback system includes a tone detector that triggers fast adaptation of the FIR filter when said tone detector detects howl.

11. Hearing aid as claimed in claim 10 wherein the anti-feedback system further includes a tone detector that detects howl, and wherein faster adaptation of the FIR filter is used when the tone detector detects howl.

12. Hearing aid as claimed in claim 11, wherein a hysteresis is used to allow for fast adaptation in a predefined period after the howl has vanished or after a transition in $\alpha_{omni}$.

13. Hearing aid as claimed in claim 1 wherein the directional processing block is part of an external feedback path estimated by the anti feedback system.

14. A method for preventing feedback in a hearing aid with an anti feedback system that operates in one of at least two adaptation modes, a fast adaptation mode and a slow adaptation mode, the method aid comprising:

receiving input signals from two or more microphones;

generating a DIR-signal with directional sensitivity and an OMNI-directional signal;

providing, as an output signal, an addition of the DIR and OMNI signals, where the addition includes subjecting both signals to gain factors before adding them, and wherein the gain, $\alpha_{omni}$, applied to the OMNI-signal has a value between 0 and 1, inclusive, and wherein the gain applied to the DIR-signal is $(1-\alpha_{omni})$;

determining whether input signals from said microphones are directional or omni-directional;

generating an alert signal to the anti feed back system, said alert indicating the adaptation mode for the anti feedback system based on the value of $\alpha_{omni}$, and controlling the addition of the DIR and OMNI signals and generating an alert signal by generating a value for $\alpha_{omni}$ based on results of said determining, such that the adaptation mode and the output signal are both governed by directional characteristics of the input signals from said microphones.

15. The method of claim 14, the method further including tracking changes of an external feedback path with an adaptive algorithm.

16. The method of claim 15, where the anti-feedback system includes an FIR filter and a parametrized model of the feedback, such that the parameters are the coefficients of the FIR filter.

17. The method of claim 16, the method further including:

adjusting the coefficients with the adaptive algorithm, where the adaptive algorithm is based on a prediction error method, so that energy in a residual signal after cancellation is minimized; and updating the coefficients by a step of predefined size $\mu_0$, where $\mu_0$ is a scalar value that controls how fast the FIR filter can adapt to changes in the external feedback pack.

18. The method of claim 14, where the results of said determining are generated based on a level of the OMNI-signal, a level of the DIR signal and an estimation of a signal-to-noise ratio in the input signal.

* * * * *